US005231452A

United States Patent [19]

Murayama et al.

[11] Patent Number: 5,231,452

[45] Date of Patent: Jul. 27, 1993

[54] IMAGE FORMING CONTROL METHOD USING VARIABLE STATE FACTORS AND FUZZY COMPUTATION

[75] Inventors: Hisao Murayama; Shinji Kato, both of Kawasaki; Tetsuya Morita, Yokohama; Mitsuhisa Kanaya, Tokyo, all of Japan

[73] Assignee: Ricoh Company, Ltd., Tokyo, Japan

[21] Appl. No.: 872,774

[22] Filed: Apr. 23, 1992

[30] Foreign Application Priority Data

Apr. 24, 1991 [JP] Japan ..... 3-122344
Apr. 4, 1992 [JP] Japan ..... 4-112215

[51] Int. Cl.[5] ..... G03G 15/14; G03G 21/00

[52] U.S. Cl. ..... 355/208; 355/271; 355/315

[58] Field of Search ..... 355/208, 210, 315, 204, 355/271

[56] References Cited

U.S. PATENT DOCUMENTS 4,286,862 9/1981 Akita et al. ..... 355/315
4,341,457 7/1982 Nakahata et al. ..... 355/274
4,502,777 3/1985 Okamoto et al. ..... 355/208
4,896,192 1/1990 Kinoshita ..... 355/315
5,029,314 7/1991 Katsumi et al. ..... 355/208
5,142,332 8/1992 Osawa et al. ..... 355/208

FOREIGN PATENT DOCUMENTS 0402143 12/1990 European Pat. Off. .
0415752 3/1991 European Pat. Off. .

*Primary Examiner*—Fred L. Braun
*Attorney, Agent, or Firm*—Oblon, Spivak, McClelland, Maier & Neustadt

[57] ABSTRACT

An image forming method for forming an image by transferring toner image formed on a photoconductive element to a paper sheet or similar recording medium. Variable factors affecting image transfer, paper separation and paper transport characteristics are classified. An image transfer state, a paper separation state and a paper transport state are each estimated as a combination of membership functions of the variable factors to determine an image transfer condition, a paper separation condition, a paper transport condition and auxiliary conditions such that control is executed on the basis of the determined conditions.

7 Claims, 14 Drawing Sheets

IMAGE FORMING CONTROL METHOD USING VARIABLE STATE FACTORS AND FUZZY COMPUTATION

BACKGROUND OF THE INVENTION

The present invention relates to an image forming method for controlling the transfer of an image to a paper sheet, the separation of the paper sheet, and the transport of the paper sheet. More particularly, the present invention is concerned with an image forming method for determining an image transfer condition, a paper separation condition, a paper transport condition and conditions auxiliary thereto as well as a toner image forming condition on a photoconductive element by estimating each of a transfer state, a separation state and a transport state as a combination of membership functions of various kinds of information.

An image forming apparatus capable of controlling image transfer, paper separation and paper transport is disclosed in, for example, Japanese Patent Laid-Open Publication No. 125074/1983. The apparatus disclosed in this reference includes a humidity sensor responsive to humidity inside of the apparatus, and paper transporting means having a heater for dehumidifying a recording medium, i.e., a paper sheet. The paper transporting means is controlled on the basis of the output of the humidity sensor to adjust a paper transport speed, whereby a paper sheet is constantly held in a desirable state for high image quality. On the other hand, Japanese Patent Laid-Open Publication No. 64270/1982 teaches an electrostatic copying method which measures the thickness and specific resistance of a paper sheet during the interval between the feed of the paper and the image transfer, performs calculations with the measured values, and controls various conditions relating to image transfer and paper separation in matching relation to the results of calculations. This kind of method is contemplated to promote smooth paper separation with no regard to the kind of the paper sheet and environmental conditions, thereby preventing the image quality from being degraded in the image transferring and paper separating steps.

However, the above-described conventional schemes each determines an image transfer condition, a paper separation condition and a paper transport condition on the basis of only independent control information, e.g., the output of the humidity sensor (Lai-Open Publication No. 125074/1983) or the thickness and specific resistance of a paper sheet (Laid-Open No. 64270/1982). Stated another way, the conventional schemes simply set image transfer, paper separation and paper transport conditions as fixed values or as adequate values associated with a typical situation and do not totally determine a complicated correlation of electric and physical characteristics, environmental information, time information, etc. Specifically, even when the state of a paper sheet that effects the image transfer and paper separation and transport is changed, the conventional approaches simply set up conditions which prevent the image quality from being noticeably degraded or, if the image quality is slightly degraded, eliminates a paper jam or similar fault which affects the entire system. Consequently, the set conditions are simply standard ones which are not causative of noticeable faults, i.e., not optimal ones each matching a particular situation. It follows that optimal values of image transfer, paper separation and paper transport conditions as well as conditions auxiliary thereto cannot be computed, preventing a stable attractive image from being produced at all times.

Generally, regarding the relation between the characteristics of paper and the transfer, separation and transport characteristic, thin paper or similar extremely pliant paper is not easily separable while color paper and paper whose electric resistance has been lowered due to, for example, moisture are inferior in transferability than the others. Further, bond paper or similar rough paper has poor transferability. On the other hand, a paper sheet which does not have a toner image at a leading edge portion thereof is not readily separable, and a dot image, line image or similar halftone image is degraded when the transfer condition is excessive. In addition, since an image transferring device and a paper separating device deteriorate due to aging, the transfer, separation and transport abilities cannot be maintained constant unless the various conditions are changed.

SUMMARY OF THE INVENTION

It is therefore an object of the present invention to provide an image forming method which enhances efficient transfer, separation and transport of a paper sheet and thereby insures attractive images with no regard to the kind of paper and environmental conditions while noticeably reducing the frequency of paper jam at image transfer and paper separation stations.

It is another object of the present invention to provide an image forming method which minimizes the amount of toner that remains on a photoconductive element after image transfer, thereby improving the cleaning ability and reducing wasteful toner consumption.

It is another object of the present invention to provide an image forming method which simplifies the control system and promotes accurate control by classifying variable factors and estimating each necessary condition as a combination of membership functions of the variable factors.

In accordance with the present invention, in an image forming method forming an image by transferring a toner image formed on a photoconductive element to a recording medium, variable factors associated with image transfer, paper separation and paper transport characteristics are classified. An image transfer state, a paper separation state and a paper transport state are each estimated as a combination of membership functions of the variable factors to thereby determine an image transfer condition, a paper separation condition and a paper transport condition and conditions auxiliary to such conditions, whereby control is effected on the basis of the conditions and auxiliary conditions determined.

Also, in accordance with the present invention, in an image forming method for forming an image by transferring a toner image formed on a photoconductive element to a recording medium, variable factors affecting image transfer, paper separation and paper transport are classified. An image transfer state, a paper separation state and a paper transport state are each estimated as a combination of membership functions of the variable factors to thereby determine an image transfer condition, a paper separation condition, a paper transport condition and conditions auxiliary to such conditions as well as a toner image forming condition on the photoconductive element, whereby control is executed on the basis of the determined conditions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
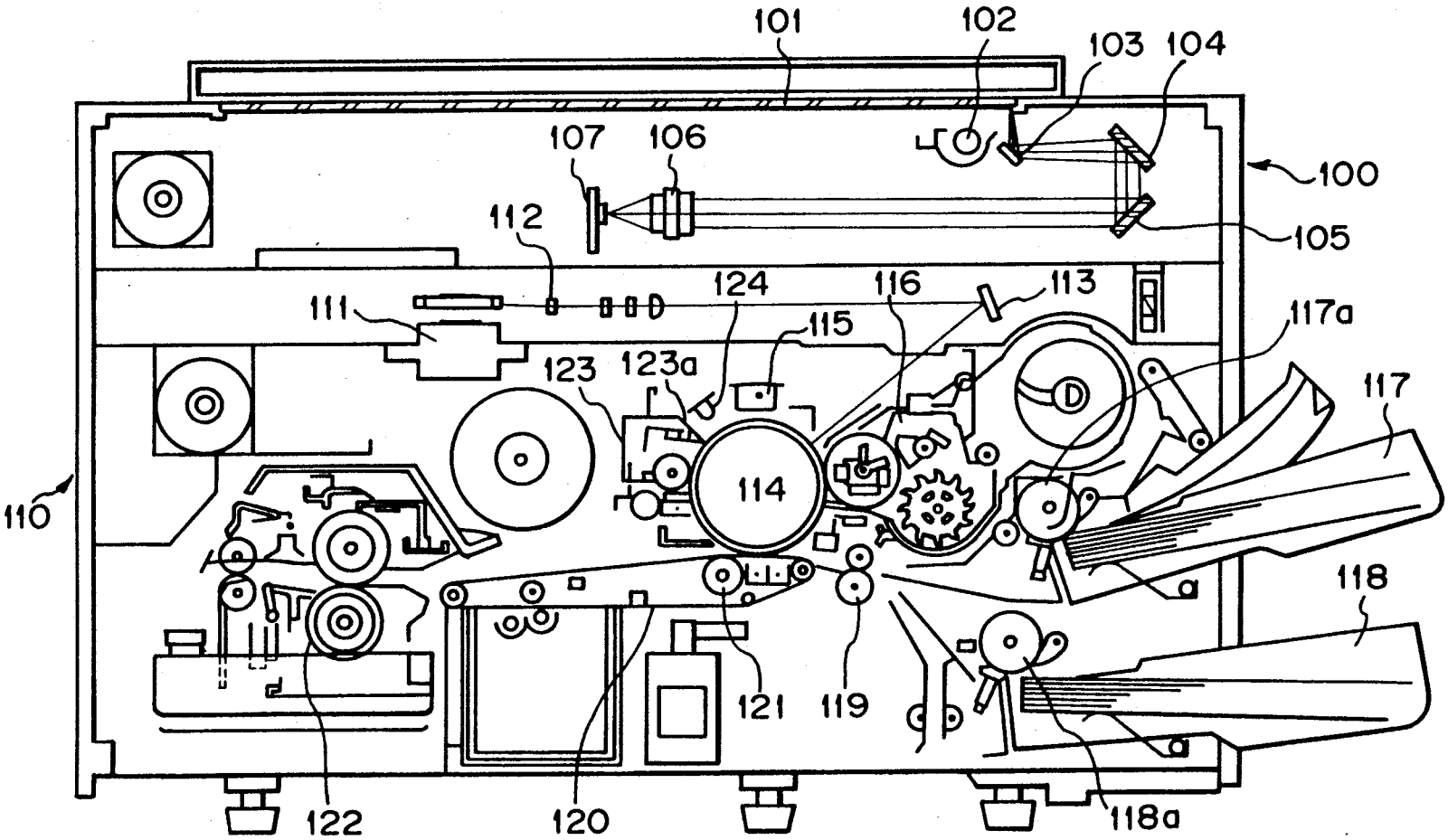
FIG. 1 is a section of an image forming apparatus for practicing an image forming method embodying the present invention.

Referring to FIG. 1 of the drawings, an image forming apparatus for practicing an image forming method embodying the present invention is shown. As shown, the apparatus is generally made up of an image reading section 100 and an image forming section for transferring image data generated by the image reading section 100 to a recording medium, e.g., a paper sheet.

The image reading section 100 includes a glass platen 101 on which a document is laid. A light source 102 illuminates the document on the glass platen 101 while moving in a predetermined direction. A mirror 103 is movable together with the light source 102 for deflecting a reflection from the document. Mirrors 103 and 105 sequentially deflect the reflection from the mirror 103. A lens 106 focuses the reflection from the mirror 105 onto a CCD (Charge Coupled Device) image sensor 107. On the other hand, the image forming section 110 includes a photoconductive drum 114 for electrostatically forming a latent image thereon. A polygonal mirror 111 is rotatable at a high speed for steering a laser beam at a constant angle. An f-theta lens 112 corrects the laser beam from the polygonal mirror 111 such that the beam has a constant interval on the surface of the drum 114. A mirror 113 reflects the laser beam from the f-theta lens 112 toward the drum 114. A main charger 115 uniformly charges the surface of the drum 114. After the charged surface of the drum 114 has been exposed by the laser beam from the mirror 113, a developing unit 116 develops the resulting latent image on the drum 114 to produce a corresponding toner image.

Paper cassettes 117 and 118 are removably mounted on the apparatus body, and each is loaded with a stack of paper sheets of particular size. Pick-up rollers 117*a* and 118*b* are respectively associated with the paper cassettes 117 and 118 for feeding the paper sheets one by one toward an image transfer station. A register roller 119 drives the paper sheet fed from any one of the paper cassettes 117 and 118 to the image transfer station at a predetermined timing. A transfer belt 120 retains and transports the paper sheet from the register roller 119. A transfer roller 121 contacts the back of the transfer belt 120 and is connected to a transfer power source, not shown. The transfer roller 121 transfers, on receiving a predetermined transfer voltage, the toner image from the drum 114 to the paper sheet retained by the transfer belt 120 and separates the paper sheet from the drum 114. A fixing unit 122 fixes the toner image carried on the paper sheet. A cleaning unit 123 has a cleaning blade 123*a* for removing the toner which remains on drum 114 after the image transfer. A discharge lamp 124 dissipates charge which also remains on the drum 114.

In operation, as the light source 102 scans a document laid on the glass platen 101, the resulting reflection from the document is incident to the CCD image sensor 107 via the mirrors 103, 104 and 105 and lens 106. As a result, the CCD image sensor 107 generates image data representative of the document. The image data is subjected to predetermined image processing and then emitted from a semiconductor laser, not shown, in the form a laser beam. The laser beam is routed through the polygonal mirror 111, f-theta lens 112 and mirror 113 to the drum 114. The laser beam, therefore, electrostatically forms a latent image on the drum 114 whose surface has been uniformly charged by the main charger 115. The developing unit 116 develops the latent image to produce a toner image. The toner image is transferred by the transfer roller 121 to a paper sheet fed from the paper cassette 117 or 118 via the register roller 119 and retained on the transfer belt 120. The paper sheet carrying the toner image is separated from the drum 114 and then transported by the transfer belt 120 to the fixing unit 122. After the toner image has been fixed on the paper sheet by the fixing unit 122, the paper sheet is driven out of the apparatus. The cleaning unit 123 removes the toner remaining on the drum 114 while the discharge lamp 124 dissipates charge also remaining on the drum 114. The drum 114 is now ready to perform another sequence of image forming steps.

As stated above, in the illustrative embodiment, a transfer voltage is applied to the transfer roller 121 via the transfer belt 120 with the result that the toner image is transferred from the drum 114 to a paper sheet.

The transfer characteristic of a toner image to a paper sheet is changed by various causes, or factors. From the time standpoint, the factors may be classified into short-term, medium-term and long-term factors. The short-term factors are the kind and thickness of a paper sheet, and the instantaneous state of a document. For example, when use is made of a relatively thin paper sheet, it is likely that the paper sheet is not smoothly separated from the drum 114 and jams a transport path. In such a case, the transfer voltage has to be lowered. When the area ratio of solid image portions of a document is low, a paper sheet and the drum 114 are apt to firmly adhere to each other, again resulting in incomplete separation. Regarding a medium term, e.g., one day, the toner concentration of a developer and, therefore, the amount of toner to be transferred to a paper sheet changes. Also, the characteristic, e.g., electric resistance of a paper sheet changes with a change in the ambient temperature and humidity, affecting the transfer ability. Further, in a long-term aspect, the characteristic of a material constituting the transfer belt 120 changes to degrade the transfer ability.

Considering the above situation, the embodiment controls the transfer voltage to be applied to the transfer roller 121 by using the following rules. Tables 1 and 2 shown below indicate control rules pertaining to the short-term variable factors. Tables 3 and 4 show control rules associated with the medium-term factors. Further, Tables 5 and 6 list control rules relating to the long-term factors.

TABLE 1

| | | | |
|---|---|---|---|
| Rule 1 | If paper is thin and document has small area ratio | → | Very low transfer voltage |
| Rule 2 | If paper is thin and document has medium area ratio | → | Low transfer voltage |
| Rule 3 | If paper is medium thickness and document has small area ratio | → | Low transfer voltage |
| Rule 4 | If paper has medium thickness and document has medium area ratio | → | Transfer voltage changed little |
| Rule 5 | If paper has medium thickness and document has high area ratio | → | High transfer voltage |
| Rule 6 | If paper is thick and document has medium area ratio | → | High transfer voltage |
| Rule 7 | If paper is thick and document has a high area ratio | → | Very high transfer voltage |

TABLE 2

| | |
|---|---|
| Rule 1 | If D = L and OD = L, then Tb = NL |
| Rule 2 | If D = L and OD = M, then Tb = NM |
| Rule 3 | If D = M and OD = L, then Tb = NM |
| Rule 4 | If D = M and OD = M, then Tb = Z |
| Rule 5 | If D = M and OD = H, then Tb = PM |
| Rule 6 | If D = H and OD = M, then Tb = PM |
| Rule 7 | If D = H and OD = H, then Tb = PL |

Figure 2:
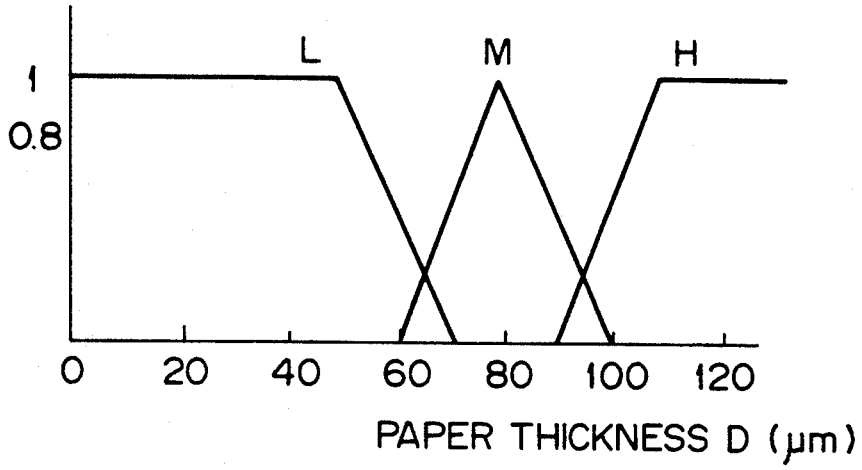
FIGS. 2–7 are graphs showing respectively the membership function of the thickness of a paper sheet, the membership function of the area ratio of a document, the membership function of the toner concentration of a developer, the membership function of relative humidity, the membership function of the duration of use, and the membership function of a transfer voltage.
Figure 3:
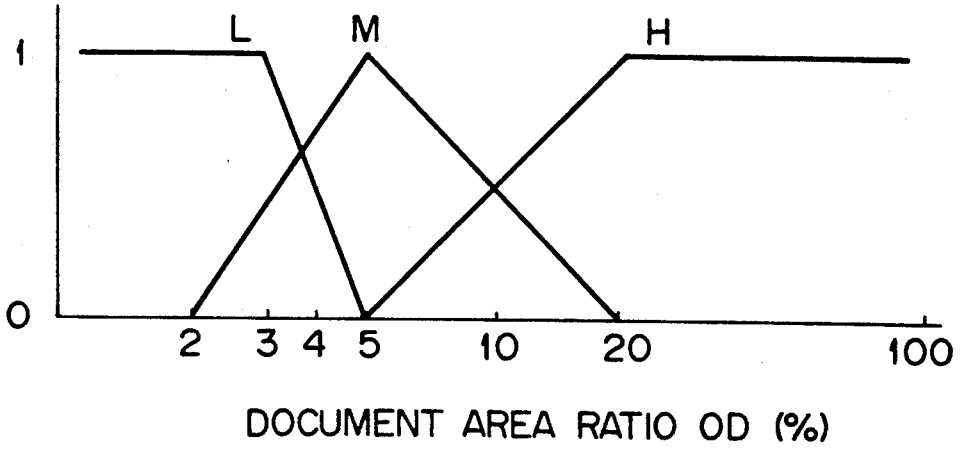

FIG. 2 is a graph showing the membership function of the thickness (D) of a paper sheet (detected by means disclosed in, for example, Japanese Patent Laid-Open Publication No. 64270/1982). FIG. 3 is a graph showing the membership function of a document area ratio (OD) (determined in terms of, for example, the output signal of a scanner).

TABLE 3

| | | | |
|---|---|---|---|
| Rule 1 | If toner concentration of developer is low and relative humidity is low | → | Very high transfer voltage |
| Rule 2 | If toner concentration of developer is low and relative humidity is medium | → | High transfer voltage |
| Rule 3 | If toner concentration of developer is medium and relative humidity is low | → | High transfer voltage |
| Rule 4 | If toner concentration of developer and relative humidity are medium | → | Transfer voltage changed little |

TABLE 3-continued

| | | | |
|---|---|---|---|
| Rule 5 | If toner concentration of developer is medium and relative humidity is low | → | Low transfer voltage |
| Rule 6 | If toner concentration of developer is high and relative humidity is medium | → | Low transfer voltage |
| Rule 7 | If toner concentration of developer and relative humidity are high | → | Very high transfer voltage |

TABLE 4

| | |
|---|---|
| Rule 1 | If T. C = L and RH = L, then Tb = PL |
| Rule 2 | If T. C = L and RH = M, then Tb = PM |
| Rule 3 | If T. C = M and RH = L, then Tb = PM |
| Rule 4 | If T. C = M and RH = M, then Tb = Z |
| Rule 5 | If T. C = M and RH = H, then Tb = NM |
| Rule 6 | If T. C = H and RH = M, then Tb = NM |
| Rule 8 | If T. C = H and RH = H, then Tb = NL |

Figure 4:
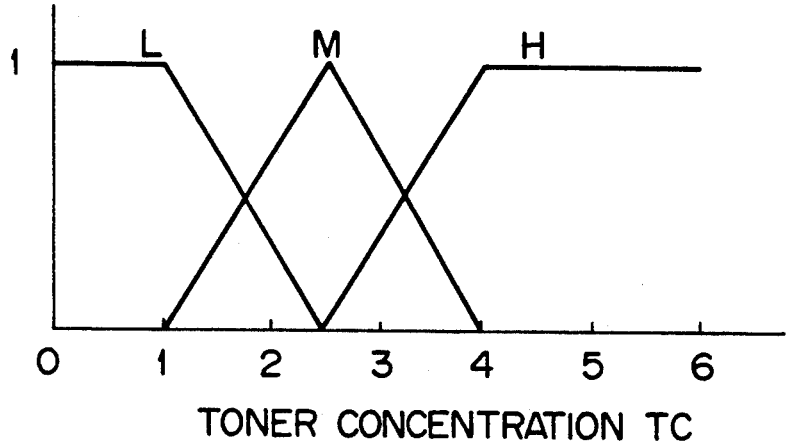
Figure 5:
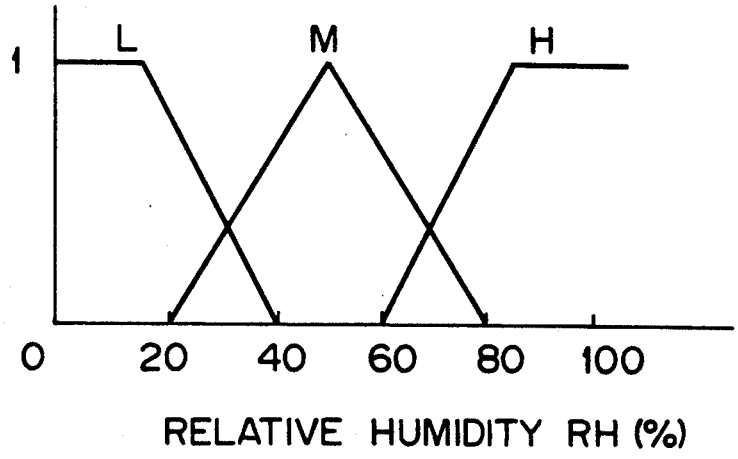

FIG. 4 is a graph showing the membership function of the toner concentration (TC) of a developer (detected by a toner concentration sensor, for example). FIG. 5 is a graph showing the membership function of the relative humidity (RH) (detected by a humidity sensor, for example).

TABLE 5

| | | | |
|---|---|---|---|
| Rule 1 | If duration of use is short | → | Transfer voltage changed little |
| Rule 2 | If duration of use is medium | → | High transfer voltage |
| Rule 3 | If duration of use is long | → | Very high transfer voltage |

TABLE 6

| | |
|---|---|
| Rule 1 | If T = L, then Tb = 2 |
| Rule 2 | If T = M, then Tb = PL |
| Rule 3 | If T = H, then Tb = PL |

Figure 6:
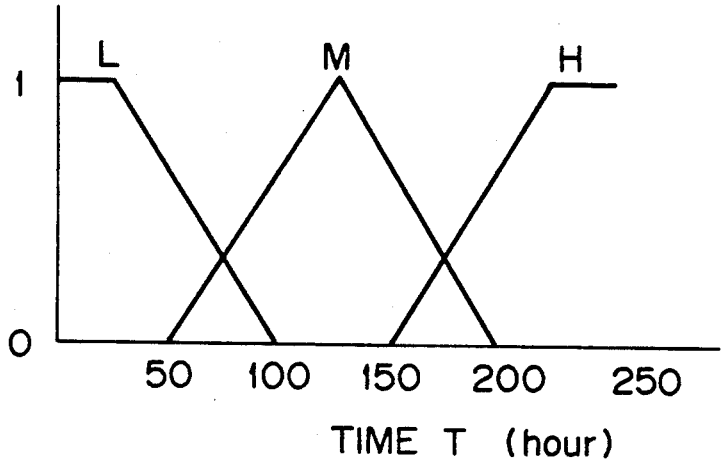
Figure 7:
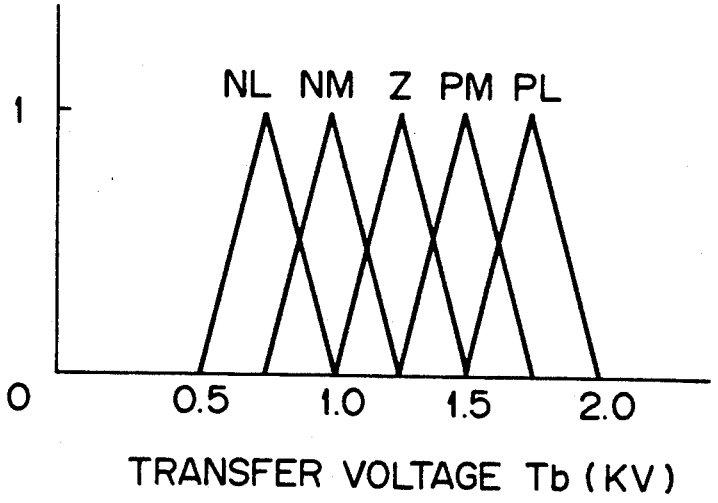

FIG. 6 is a graph showing the membership function of the duration of use (T) (counted by a timer) while FIG. 7 is a graph showing the membership function of the transfer voltage (Tb) to be controlled.

Figure 8:
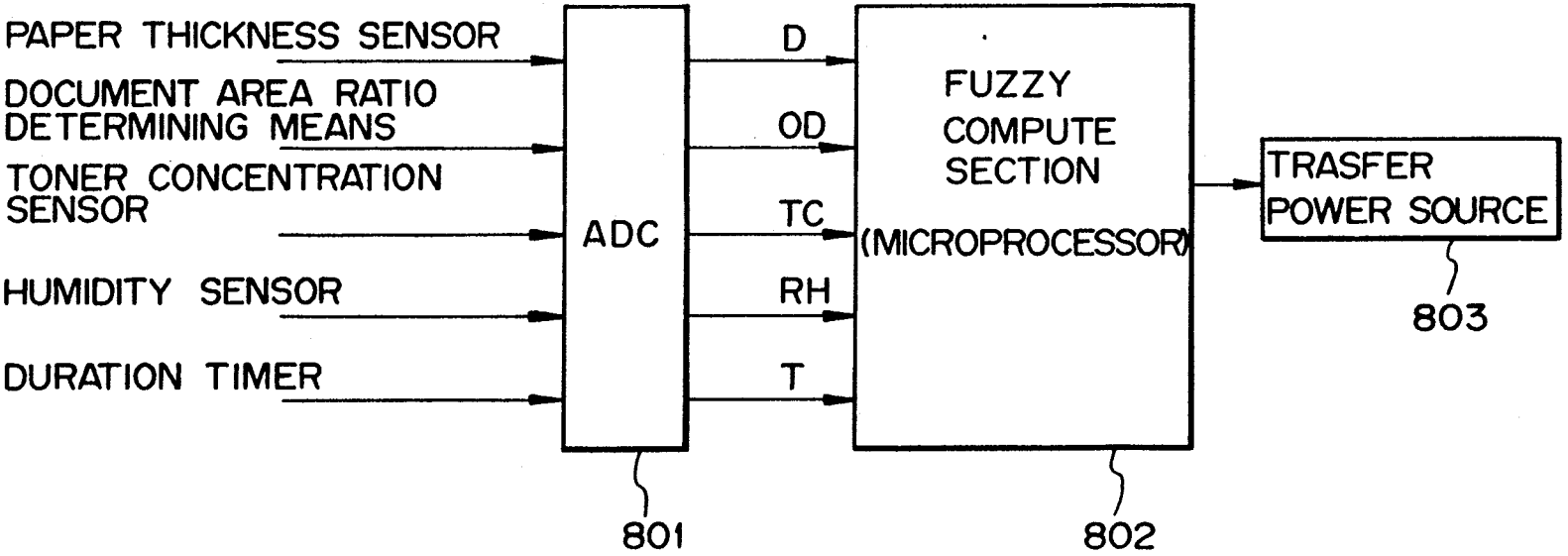
FIG. 8 is a block diagram schematically showing a control system incorporated in an image forming apparatus with which the method of the invention is practicable.

FIG. 8 schematically shows a control system incorporated in the image forming apparatus. As shown, the control system includes an analog-to-digital converter (ADC) 801 for digitizing the analog outputs of, for example, a paper thickness sensor, means for determining the area ratio of a document, a toner concentration sensor, a humidity sensor, and a timer responsive to the duration of use. A fuzzy computing section, e.g., a microprocessor 802 is responsive to the digital signals from the ADC 801 for estimating a transfer, a separation and a transport condition and conditions auxiliary thereby by fuzzy computation as a combination of the membership functions of the various signals. A transfer power source 803 is controlled by a control signal matching the result of fuzzy computation executed by the microprocessor 802.

Figure 9:
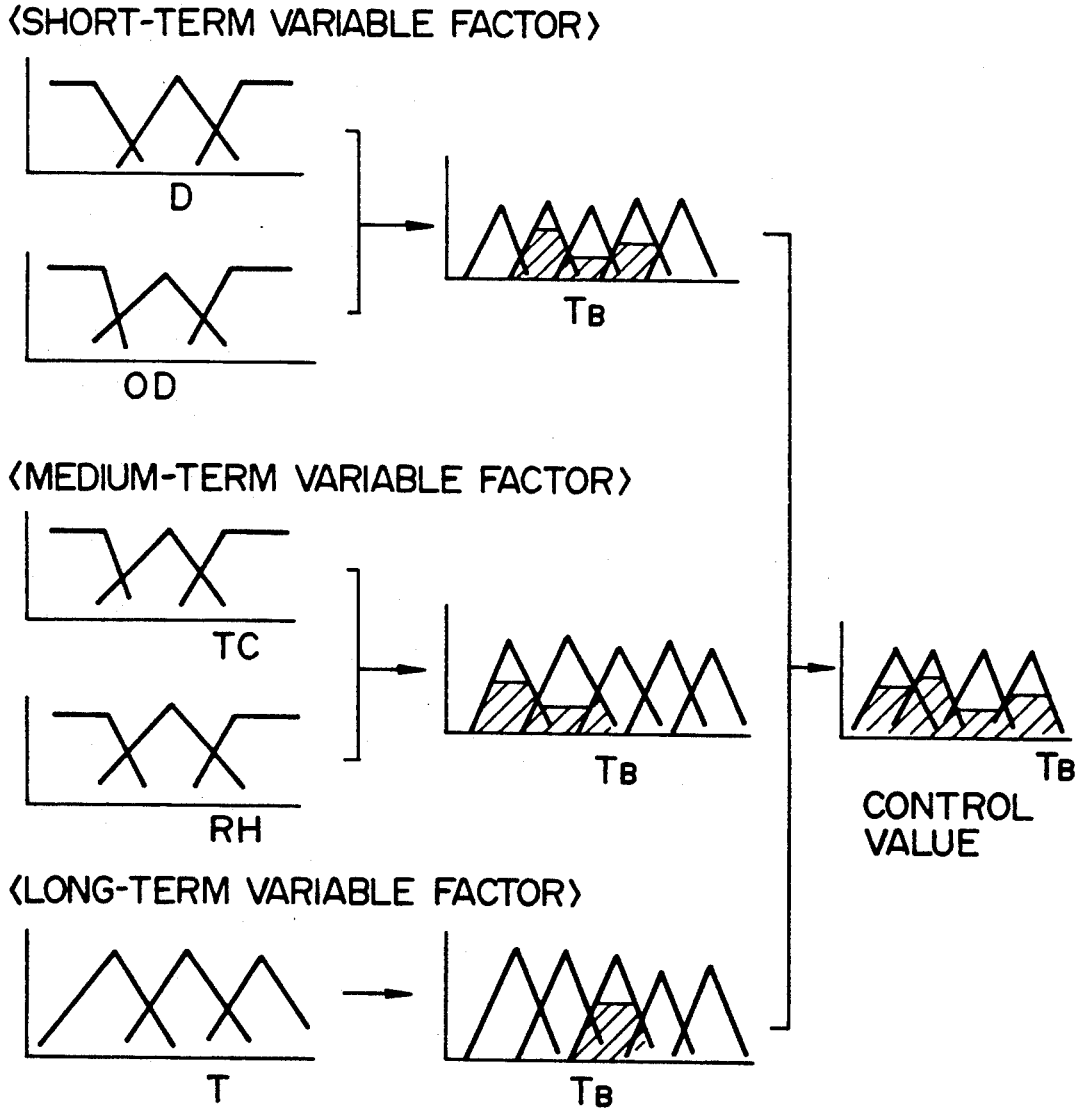
FIG. 9 is a schematic representation of a fuzzy estimation process particular to the invention.

After the fuzzy estimation of a transfer voltage which is affected by various factors, the results of estimation each being associated with a respective one of the factors are subjected to MAX combination to determine a final transfer voltage. FIG. 9 is a schematic representation of the process of such fuzzy estimation. By the above control, it is possible to determine an optimal transfer voltage for the transfer roller 121 in any instantaneous situation.

A second embodiment of the present invention will be described. In the image forming apparatus shown in FIG. 1, the factors affecting the transfer characteristic include the condition of the toner and the potential condition of the drum 114 before the image transfer, i.e., the characteristics particular to the apparatus when classified in the step or constituent part aspect. For example, when the amount of charge deposited on the toner is small (equivalent to a low toner concentration), the toner cannot be transferred to a paper sheet unless the transfer voltage is increased. When the potential of the drum 114 is high, the transfer voltage has to be lowered to insure the separation of a paper sheet from the drum 114. Characteristics other than those of the apparatus include the characteristic of a paper sheet and environment. Considering such a situation, the embodiment controls the transfer voltage to be applied to the transfer roller 121 by the following rules. Tables 7 and 8 shown below indicate the factors affecting the transfer characteristic and ascribable to the apparatus, while Tables 9 and 10 show the other factors.

TABLE 7

| | | | |
|---|---|---|---|
| Rule 1 | If toner concentration is low and drum charge potential is high | → | Very high transfer voltage |
| Rule 2 | If toner concentration is low and drum charge potential is medium | → | High transfer voltage |
| Rule 3 | If toner concentration is medium and drum charge potential is high | → | High transfer voltage |
| Rule 4 | If toner concentration and drum charge potential are medium | → | Transfer voltage changed little |
| Rule 5 | If toner concentration is medium and drum charge potential is low | → | Low transfer voltage |
| Rule 6 | If toner concentration is high and drum charge potential is medium | → | Low transfer voltage |
| Rule 7 | If toner concentration is high and drum charge potential is low | → | Very low transfer voltage |

TABLE 8

| | |
|---|---|
| Rule 1 | If T. C = L and Vd = H, then Tb = PL |
| Rule 2 | If T. C = L and Vd = M, then Tb = PM |
| Rule 3 | If T. C = M and Vd = H, then Tb = PM |
| Rule 4 | If T. C = M and Vd = M, then Tb = Z |
| Rule 5 | If T. C = M and Vd = L, then Tb = NM |
| Rule 6 | If T. C = H and Vd = M, then Tb = NM |
| Rule 7 | If T. C = H and Vd = L, then Tb = NL |

TABLE 9

| | | | |
|---|---|---|---|
| Rule 1 | If paper is thin and relative humidity is low | → | Very low transfer voltage |
| Rule 2 | If paper is thin and relative humidity is medium | → | Low transfer voltage |
| Rule 3 | If paper has medium thickness and relative humidity is low | → | Low transfer voltage |
| Rule 4 | If paper has medium thickness and relative humidity is medium | → | Transfer voltage changed little |
| Rule 5 | If paper has medium thickness and relative humidity is high | → | High transfer voltage |
| Rule 6 | If paper is thick and relative humidity is medium | → | High transfer voltage |
| Rule 7 | If paper is thick and relative humidity is high | → | Very high transfer voltage |

TABLE 10

| | |
|---|---|
| Rule 1 | If D = L and RH = L, then Tb = NL |
| Rule 2 | If D = L and RH = M, then Tb = NM |
| Rule 3 | If D = M and RH = L, then Tb = NM |
| Rule 4 | If D = M and RH = M, then Tb = Z |
| Rule 5 | If D = M and RH = H, then Tb = PM |
| Rule 6 | If D = H and RH = M, then Tb = PM |

TABLE 10-continued

| | |
|---|---|
| Rule 7 | If D = H and RH = H, then Tb = PL |

Figure 10:
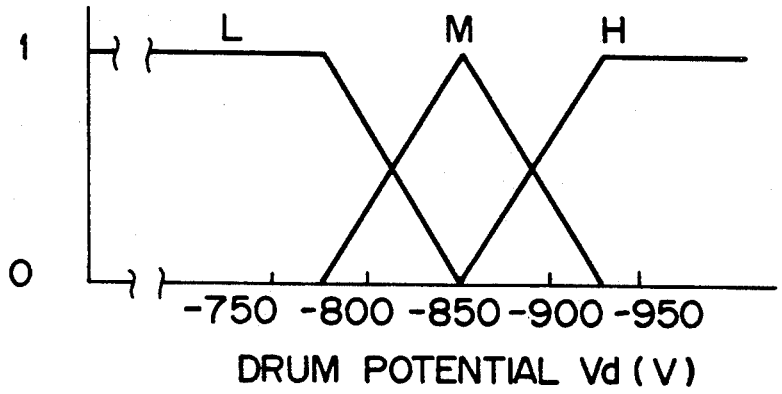
FIG. 10–13 are graphs showing respectively the membership function of a drum potential, the membership function of the amount of toner deposition, the membership function of the electric resistance of a paper sheet, and the membership function of the variation of relative humidity.

FIG. 10 is a graph showing the membership function of the potential (Vd) of the drum 114 (detected by a potential sensor, for example). The other membership functions are the same as those of the first embodiment.

A third embodiment of the present invention which will be described hereinafter classifies the variable factors affecting the transfer characteristic into three kinds, i.e., the characteristic of a developer, the characteristic of a paper sheet, and the characteristic of environment. The characteristic of a developer includes the toner concentration of a developer, and the amount of toner deposition on the drum 114. The characteristic of a paper sheet includes electric resistance while the environment includes relative humidity and the amount of change, or variation, thereof. Considering such a situation, the embodiment controls the transfer voltage to the transfer roller 121 by using the following rules. Tables 11 and 12 shown below indicate the variable factors of a developer, Tables 13 and 14 show the variable factors of a paper sheet, and Tables 15 and 16 show the variable factors of environment.

TABLE 11

| | | | |
|---|---|---|---|
| Rule 1 | If toner concentration is low and toner deposition is small | → | Very high transfer voltage |
| Rule 2 | If toner concentration is low and toner deposition is medium | → | High transfer voltage |
| Rule 3 | If toner concentration is medium and toner deposition is small | → | High transfer voltage |
| Rule 4 | If toner concentration is medium and toner deposition is medium | → | Transfer voltage changed little |
| Rule 5 | If toner concentration is medium and toner deposition is great | → | Low transfer voltage |
| Rule 6 | If toner concentration is high and toner deposition is medium | → | Low transfer voltage |
| Rule 7 | If toner concentration is high and toner deposition is great | → | Very low transfer voltage |

TABLE 12

| | |
|---|---|
| Rule 1 | If T. C = L and MA = L, then Tb = PL |
| Rule 2 | If T. C = L and MA = M, then Tb = PM |
| Rule 3 | If T. C = M and MA = L, then Tb = PM |
| Rule 4 | If T. C = M and MA = M, then Tb = Z |
| Rule 5 | If T. C = M and MA = H, then Tb = NM |
| Rule 6 | If T. C = M and MA = M, then Tb = NM |
| Rule 7 | If T. C = M and MA = H, then Tb = NL |

TABLE 13

| | | | |
|---|---|---|---|
| Rule 1 | If paper is thin and has high electric resistance | → | Very low transfer voltage |
| Rule 2 | If paper is thin and has medium electric resistance | → | Low transfer voltage |
| Rule 3 | If paper has medium thickness and high electric resistance | → | Low transfer voltage |
| Rule 4 | If paper has medium thickness and medium electric resistance | → | Transfer voltage changed little |
| Rule 5 | If paper has medium thickness and low electric resistance | → | High transfer voltage |
| Rule 6 | If paper is thick and has medium electric resistance | → | High transfer voltage |
| Rule 7 | If paper is thick and has low electric resistance | → | Very high transfer voltage |

TABLE 14

| | |
|---|---|
| Rule 1 | If D = L and R = H, then Tb = NL |
| Rule 2 | If D = L and R = M, then Tb = NM |
| Rule 3 | If D = M and R = H, then Tb = NM |
| Rule 4 | If D = M and R = M, then Tb = Z |

TABLE 14-continued

| | |
|---|---|
| Rule 5 | If D = M and R = L, then Tb = PM |
| Rule 6 | If D = M and R = M, then Tb = PM |
| Rule 7 | If D = H and R = L, then Tb = PL |

TABLE 15

| | | | |
|---|---|---|---|
| Rule 1 | If relative humidity is low and tending to fall | → | Very low transfer voltage |
| Rule 2 | If relative humidity is low and changes little | → | Low transfer voltage |
| Rule 3 | If relative humidity is medium and tending to fall | → | Low transfer voltage |
| Rule 4 | If relative humidity is medium and changes little | → | Transfer voltage changed little |
| Rule 5 | If relative humidity is medium and tending to rise | → | High transfer voltage |
| Rule 6 | If relative humidity is high and changes little | → | High transfer voltage |
| Rule 7 | If relative humidity is high and tending to rise | → | Very high transfer voltage |

TABLE 16

| | |
|---|---|
| Rule 1 | If RH = L and ΔRH = N, then Tb = NL |
| Rule 2 | If RH = L and ΔRH = Z, then Tb = NM |
| Rule 3 | If RH = M and ΔRH = N, then Tb = NM |
| Rule 4 | If RH = M and ΔRH = Z, then Tb = Z |
| Rule 5 | If RH = M and ΔRH = P, then Tb = PM |
| Rule 6 | If RH = H and ΔRH = Z, then Tb = PM |
| Rule 7 | If RH = H and ΔRH = P, then Tb = PL |

Figure 11:
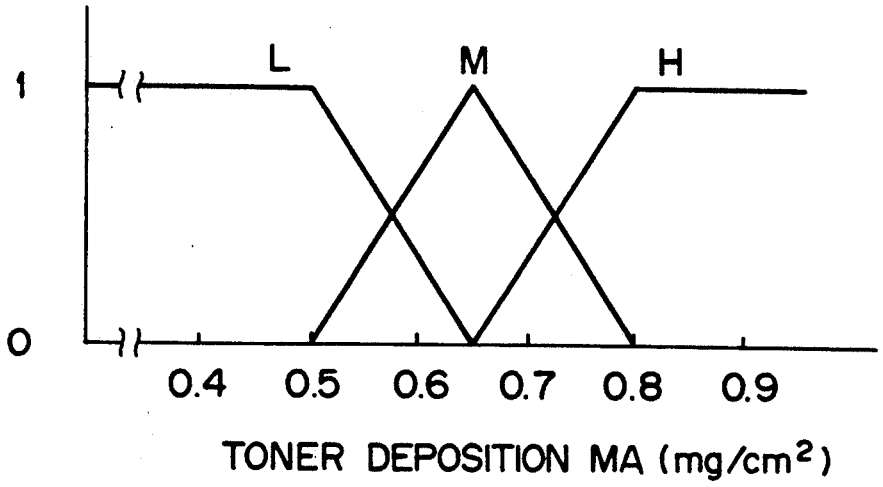
Figure 12:
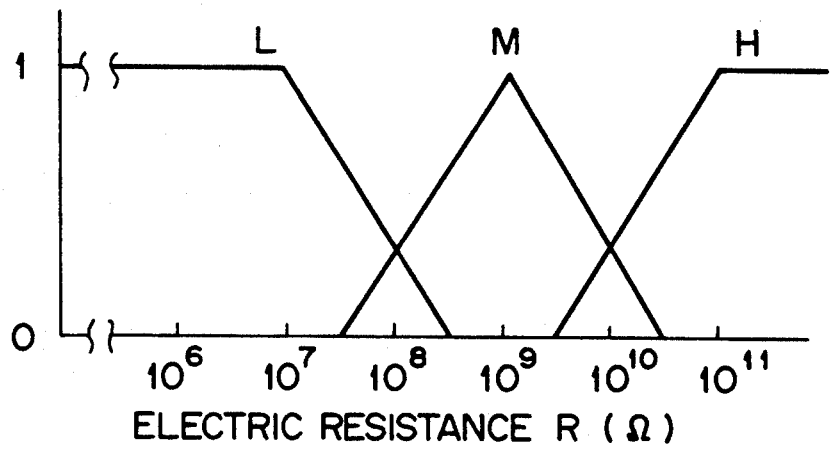
Figure 13:
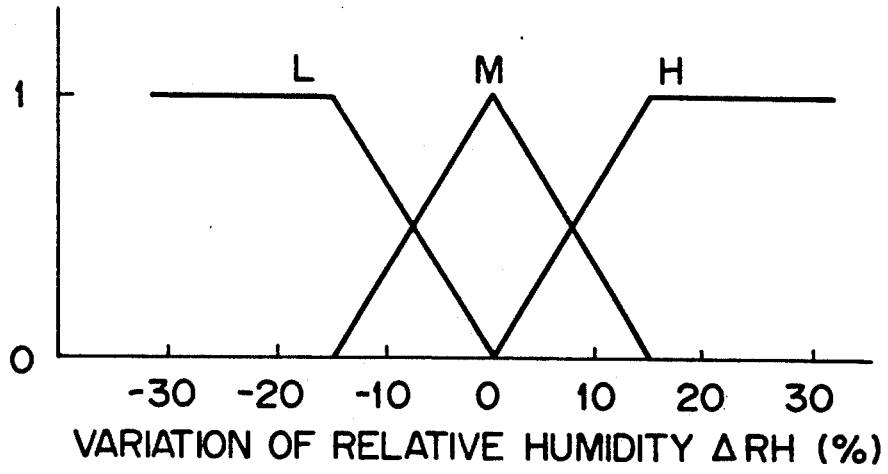

FIG. 11 is a graph showing the membership function of the amount of toner deposition (MA) (sensed by an optical reflection density sensor, for example). FIG. 12 is a graph showing the membership function of the electric resistance (R (Ω)) of the paper sheet (detected by, for example, a method disclosed in Japanese Patent Laid-Open Publication No. 64270/1982). FIG. 13 is a graph showing the membership function of the variation (ΔRH) of the relative humidity (detected by a humidity sensor, for example). The other membership functions are the same as those of the previous embodiments.

Effecting fuzzy estimation with each of the variable factors as stated above is successful in realizing stable control by eliminating unnatural control values. Further, since the variable factors are classified with respect to time and subjected to fuzzy estimation, control can be executed even when the factors change with the elapse of time. In addition, since the variable factor system is classified on a step basis or on a constituent part basis and subjected to fuzzy estimation, control is achievable even when the factors change.

A fourth embodiment of the present invention will be described hereinafter. The image transfer and paper separation ability changes with the kind and thickness of a paper sheet and the condition of a document in a short-term sense, changes with a change in the amount of toner ascribable to a change in the amount of frictional charge of the developer and the toner concentration of the developer as well as a change in environment in a medium-term sense, and changes with a change in the characteristic of the transfer belt ascribable to the total duration of use and the total number of copies produced in a long-term sense. To improve and maintain the image transfer and paper separation ability adequate, simply controlling the transfer voltage and other conditions directly relating to the transfer ability does not suffice. For example, when the amount of toner deposition on the photoconductive drum is extremely small, no adequate conditions, of course, are available with the transfer voltage. Moreover, even if the amount of toner deposition on the drum is adequate, when the transfer voltage has to be made higher than the creeping discharge and gaseous discharge due to, for example, a particular condition of a paper sheet, it is necessary to change conditions other than the transfer condition to thereby ensure attractive images.

Figure 14:
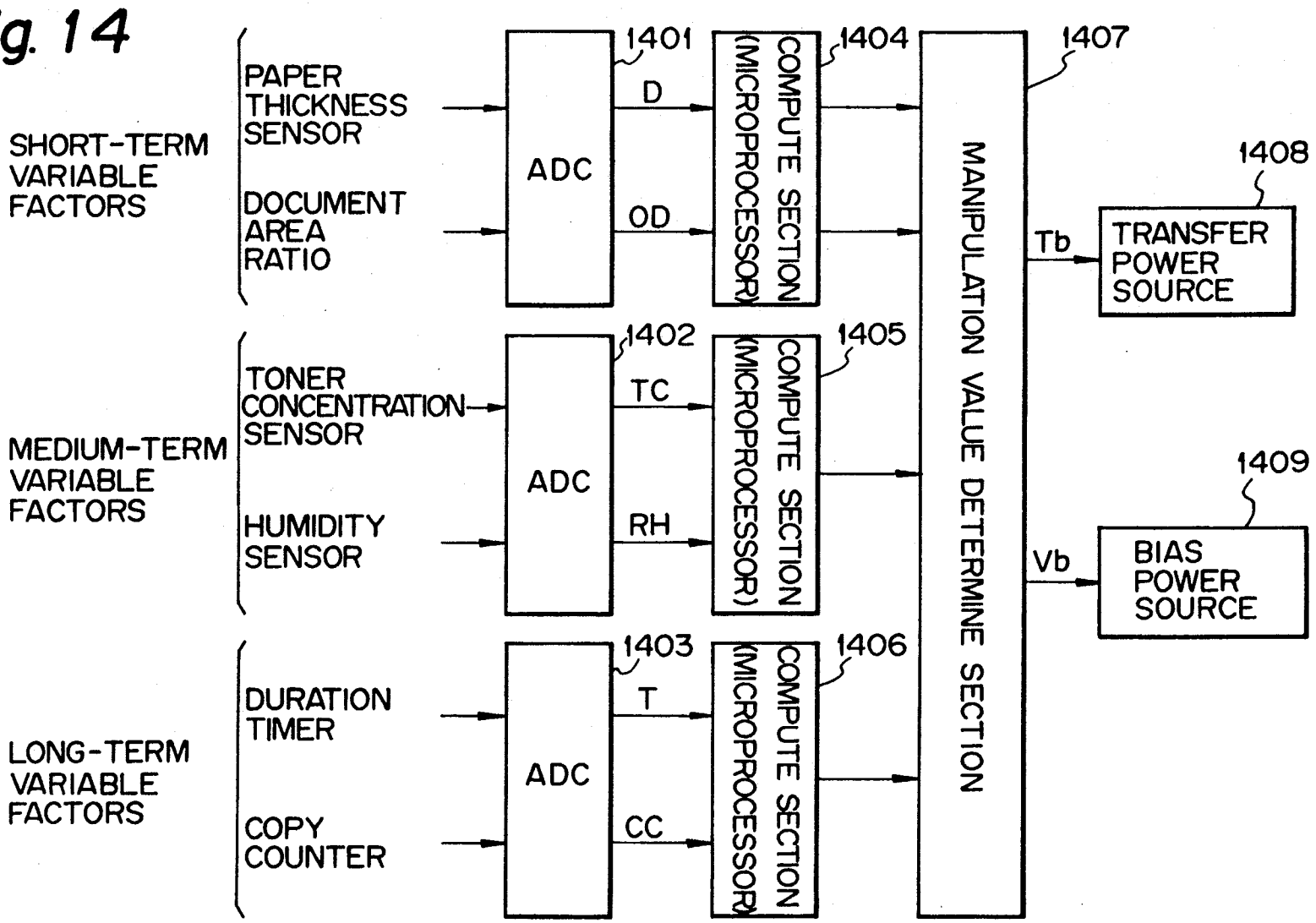
FIG. 14 is a block diagram schematically showing another control system with which the invention is practicable.

FIG. 14 shows a construction in which an exclusive fuzzy computing section is assigned to each of the short-term, medium-term and long-term variable factors for determining a transfer voltage and a bias for development. There are shown in FIG. 14 ADCs 1401–1403 each converting the outputs of various sensors to digital signals, fuzzy computing sections, e.g., microprocessors 1404–1406 responsive to, respectively, the digital signals from the ADCs 1401–1403 for executing fuzzy computation based on the estimation to produce combinations of the following membership functions of the signals, a manipulation value determining section 1407 for determining manipulation values meant for the respective subjects of control on the basis of the outputs of the computing sections 1404–1406, a transfer power source 1408 to be manipulated, and a bias power source 1409 to be manipulated.

In the above construction, paper thickness information from a paper thickness sensor and document area ratio information are applied to the ADC 1401 as short-term variable factors and converted to digital signals D and OD, respectively. The fuzzy computing section 1404 executes processing with the digital signals D and OD according to the following control rules (Tables 17 and 18) assigned to short-term variable factors.

TABLE 17

| | | | |
|---|---|---|---|
| Rule 1 | If paper is very thin and document area ratio is small | → | Very low transfer voltage and low bias |
| Rule 2 | If paper is thin and document area ratio is small | → | Low transfer voltage and bias changed little |
| Rule 3 | If paper is thin and document area ratio is medium | → | Low transfer voltage and bias changed little |
| Rule 4 | If paper has medium thickness and document area ratio is medium | → | Transfer voltage and bias changed little |
| Rule 5 | If paper is thick and document area ratio is high | → | High transfer voltage and bias changed little |
| Rule 6 | If paper is thick and document area ratio is medium | → | High transfer voltage and bias changed little |
| Rule 7 | If paper is very thick and document area ratio is great | → | Very high transfer voltage and high bias |

TABLE 18

| | |
|---|---|
| Rule 1 | If D = LL and OD = L, then ΔTb = NL and ΔVb = NM |
| Rule 2 | If D = L and OD = L, then ΔTb = NM and ΔVb = Z |
| Rule 3 | If D = L and OD = M, then ΔTb = NM and ΔVb = Z |
| Rule 4 | If D = M and OD = M, then ΔTb = Z and ΔVb = Z |
| Rule 5 | If D = H and OD = H, then ΔTb = PM and ΔVb = Z |
| Rule 6 | If D = H and OD = L, then ΔTb = NL and ΔVb = Z |
| Rule 7 | If D = HH and OD = H, then ΔTb = PL and ΔVb = PM |

Regarding the medium-term variable factors, concentration information and humidity information from a toner concentration sensor and a humidity sensor, respectively, are applied to the ADC 1402 to be converted to digital signals TC and RH. The fuzzy computing section 1405 executes fuzzy computation with the digital signals TC and RH according to the following control rules (Tables 19 and 20).

TABLE 19

| | | | |
|---|---|---|---|
| Rule 1 | If toner concentration is low and relative humidity is low | → | Very high bias |
| Rule 2 | If toner concentration is low and relative humidity is medium | → | High bias |
| Rule 3 | If toner concentration is medium and relative humidity is low | → | High bias |
| Rule 4 | If toner concentration and relative humidity are medium | → | Bias changed little |
| Rule 5 | If toner concentration is medium and relative humidity is high | → | Low bias |
| Rule 6 | If toner concentration is high and relative humidity is medium | → | Low bias |
| Rule 7 | If toner concentration and relative humidity are high | → | Very low bias |

TABLE 20

| | |
|---|---|
| Rule 1 | If T. C = L and RH = L, then Vb = PL |
| Rule 2 | If T. C = L and RH = M, then Vb = PM |
| Rule 3 | If T. C = M and RH = L, then Vb = PM |
| Rule 4 | If T. C = M and RH = M, then Vb = Z |
| Rule 5 | If T. C = M and RH = H, then Vb = NM |
| Rule 6 | If T. C = H and RH = M, then Vb = NM |
| Rule 7 | If T. C = H and RH = H, then Vb = NL |

As for the long-term variable factors, timer information and copy number information from a duration-of-use timer and a copy counter, respectively, are fed to the ADC 1403 to be converted to digital signals T and CC. The fuzzy computing section 1406 executes fuzzy computation with the digital signals T and CC according to the following control rules (Tables 21 and 22).

TABLE 21

| | | | |
|---|---|---|---|
| Rule 1 | If duration is short and copy number is small | → | Very low transfer voltage |
| Rule 2 | If duration is short and copy number is medium | → | Low transfer voltage |
| Rule 3 | If duration is short and copy number is great | → | Low transfer voltage |
| Rule 4 | If duration and copy number are medium | → | Transfer voltage changed little |
| Rule 5 | If duration is long and copy number is small | → | High transfer voltage |
| Rule 6 | If duration is long and copy number is medium | → | High transfer voltage |
| Rule 7 | If duration is long and copy number is great | → | Very high transfer voltage |

TABLE 22

| | |
|---|---|
| Rule 1 | If T = L and CC = L, then Tb = PL |
| Rule 2 | If T = L and CC = M, then Tb = PM |
| Rule 3 | If T = L and CC = H, then Tb = PM |
| Rule 4 | If T = M and CC = M, then Tb = Z |
| Rule 5 | If T = H and CC = L, then Tb = NM |
| Rule 6 | If T = H and CC = M, then Tb = NM |
| Rule 7 | If T = H and CC = H, then Tb = NL |

As stated above, the embodiment determines a transfer voltage and a bias voltage for development by the fuzzy computation using the variable factors. Specifically, the embodiment determines a transfer voltage and a bias voltage by detecting information relating to short-term variable factors, determines a reference bias voltage on the basis of information relating to medium-term variable factors, and determines a reference transfer voltage on the basis of information relating to long-term variable factors, thereby selectively controlling the transfer voltage or the bias voltage. As a result, a transfer voltage and a bias voltage matching any particular situation are achievable to insure attractive images while eliminating a paper jam or similar fault.

It is to be noted that the fuzzy computing sections 1404–1406 shown in FIG. 14 may effect control selectively in matching relation to the detection timings of the respective variable factors in order to further reduce the frequency of detection and that of fuzzy calculation. In the above embodiment, the long-term, medium-term and short-term factors may be detected every 1,000 copies, every 100 copies, and every copy, respectively, to reduce the frequency of detection and that of fuzzy calculation. Even with such detection, the above-described advantage is also achievable since the factors are classified with respect to time.

Figure 15:
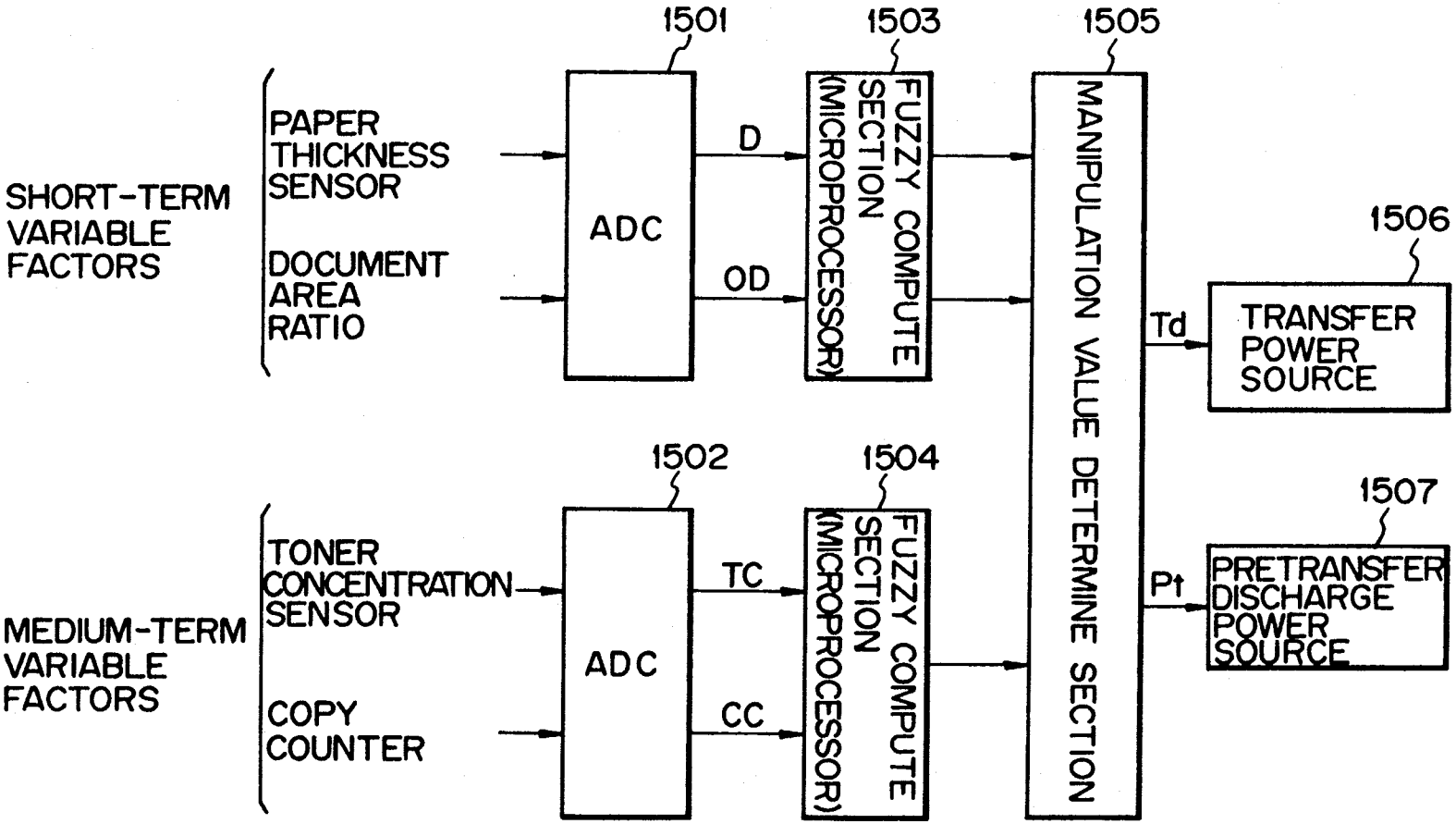
FIG. 15 is a block diagram schematically showing a further control system with which the invention is practicable.

FIG. 15 shows a construction for controlling the transfer voltage and the quantity of light for pretransfer discharge on the basis of information which relates to short-term and medium-term variable factors. The medium-term and short-term factors are detected every 500 copies and every copy, respectively. In FIG. 15, there are shown ADCs 1501 and 1502 each converting various information signals from sensors to digital signals, fuzzy computing sections, e.g., microprocessors 1503 and 1504 responsive to, respectively, the digital signals from the ADCs 1501 and 1502 for executing fuzzy computation to estimate the combinations of the following membership functions of the signals, a manipulation value determining section 1505 for determining manipulation values meant for the subjects of control in response to the outputs of the computing sections 1503 and 1504, a transfer power source 1506 to be manipulated, and a pretransfer discharge power source 1507 to be manipulated.

In the above construction, thickness information from a paper thickness sensor and document area ratio information are applied to the ADC 1501 as short-term variable factors and converted to digital signals D and OD, respectively. The fuzzy computing section 1503 executes fuzzy computation with the signals D and OD according to the following control rules assigned to short-term factors.

TABLE 23

| | | | |
|---|---|---|---|
| Rule 1 | If paper is thin and document area ratio is small | → | Very low transfer voltage and low light quantity |
| Rule 2 | If paper is thin and document area ratio is medium | → | Low transfer voltage and light quantity changed little |
| Rule 3 | If paper has medium thickness and document area ratio is small | → | Transfer voltage changed little and low light quantity |
| Rule 4 | If paper thickness and document area ratio are medium | → | Transfer voltage and light quantity little changed |
| Rule 5 | If paper thickness is medium and document area ratio is high | → | Transfer voltage changed little and high light quantity |
| Rule 6 | If paper is thick and document area ratio is medium | → | High transfer voltage and light quantity changed little |
| Rule 7 | If paper is thick and document area ratio is high | → | Very high transfer voltage and high light quantity |

TABLE 24

| | |
|---|---|
| Rule 1 | If D = L, OD = L, then Tb = NL and ΔPT = NL |
| Rule 2 | If D = L, OD = M, then Tb = NM and ΔPT = Z |
| Rule 3 | If D = M, OD = L, then Tb = NM and ΔPT = NM |
| Rule 4 | If D = M, OD = M, then Tb = Z and ΔPT = Z |
| Rule 5 | If D = M, OD = H, then Tb = PM and ΔPT = PM |
| Rule 6 | If D = H, OD = M, then Tb = PM and ΔPT = Z |

TABLE 24-continued

| | |
|---|---|
| Rule 7 | If D = H, OD = H, then Tb = PL and ΔPT = PL |

Regarding the medium-term variable factors, concentration information and copy number information from a toner concentration sensor and a copy counter, respectively, are applied to the ADC 1502 to be converted to digital signals TC and CC. The fuzzy computing section 504 executes fuzzy computation with the digital signals TC and CC according to the following control rules assigned to medium-term factors.

TABLE 25

| | | | |
|---|---|---|---|
| Rule 1 | If toner concentration is low and copy number is small | → | Very low light quantity |
| Rule 2 | If toner concentration is low and copy number is medium | → | Low light quantity |
| Rule 3 | If toner concentration is medium and copy number is small | → | Low light quantity |
| Rule 4 | If toner concentration and copy number are medium | → | Light quantity changed little |
| Rule 5 | If toner concentration is medium and copy number is great | → | High light quantity |
| Rule 6 | If toner concentration is high and copy number is medium | → | High light quantity |
| Rule 7 | If toner concentration and copy number are great | → | Very high light quantity |

TABLE 26

| | |
|---|---|
| Rule 1 | If T. C = L and T = L, then PT = NL |
| Rule 2 | If T. C = L and T = M, then PT = NM |
| Rule 3 | If T. C = M and T = L, then PT = NM |
| Rule 4 | If T. C = M and T = M, then PT = Z |
| Rule 5 | If T. C = M and T = H, then PT = PM |
| Rule 6 | If T. C = H and T = M, then PT = PM |
| Rule 7 | If T. C = H and T = H, then PT = PL |

As stated above, the embodiment executes selective control by the fuzzy calculation of a transfer voltage and a quantity of light for pretransfer discharge in relation to the associated variable factors. The embodiment, therefore, enhances efficient image transfer and maintains high image quality while allowing a minimum of paper jam to occur.

Figure 16:
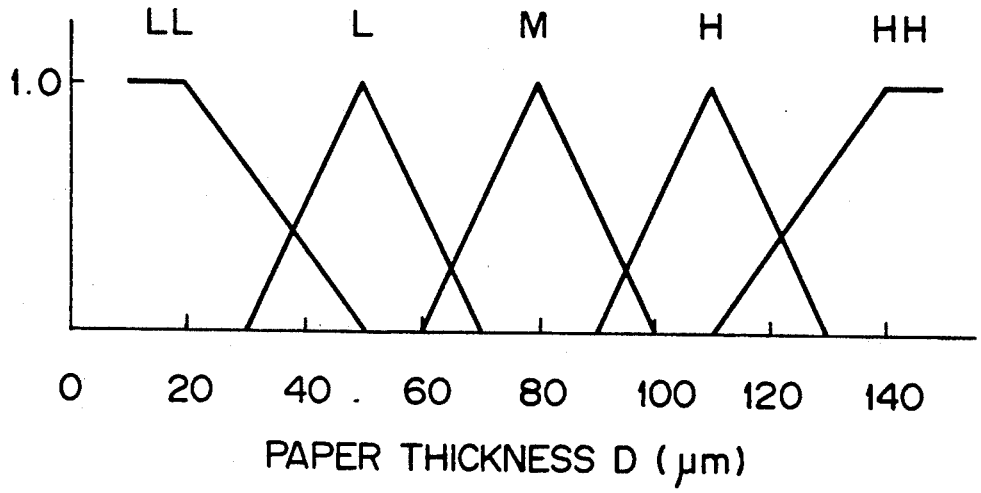
FIGS. 16–22 are graphs showing respectively the membership function of the thickness of a paper sheet, the membership function of the correction amount of a transfer voltage, the membership function of the correction amount of a bias for development, the membership function of the reference value of a bias for development, the membership function of the number of copies produced, the membership function of the reference value of the quantity of pretransfer discharge light, and the membership function of the correction amount of such a quantity of light.
Figure 17:
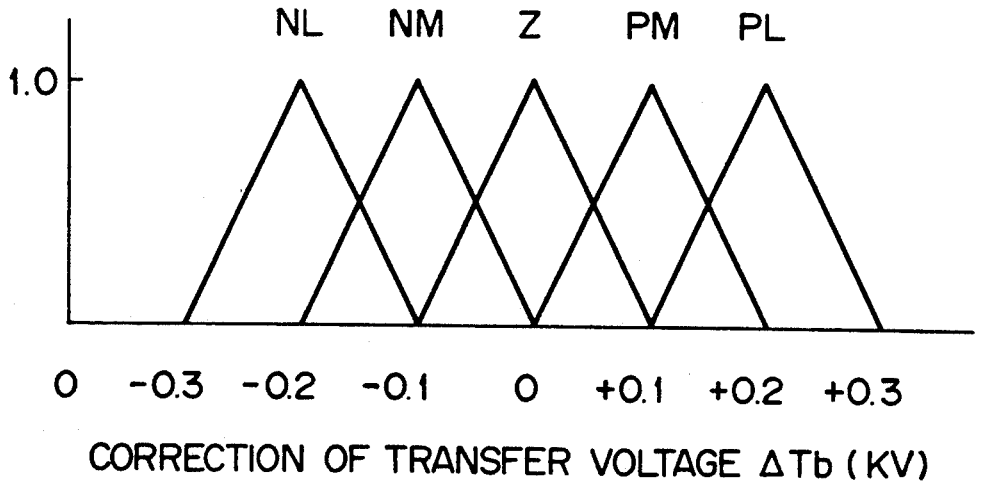
Figure 18:
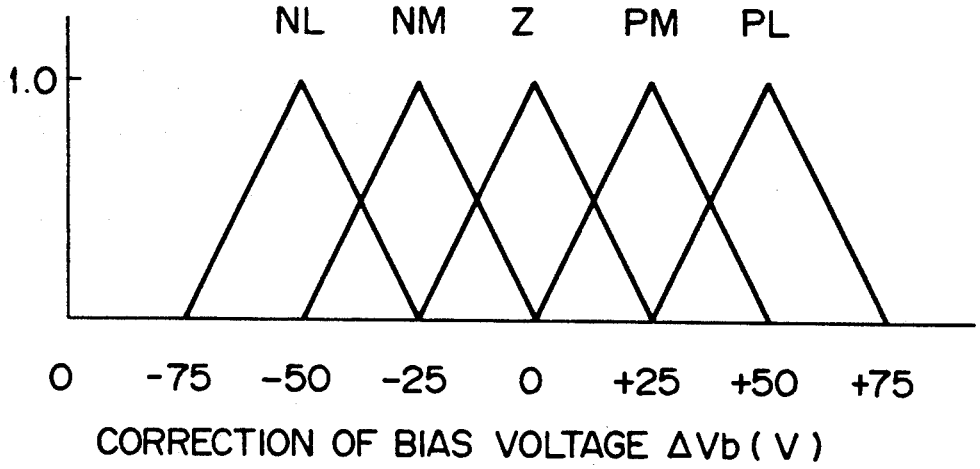
Figure 19:
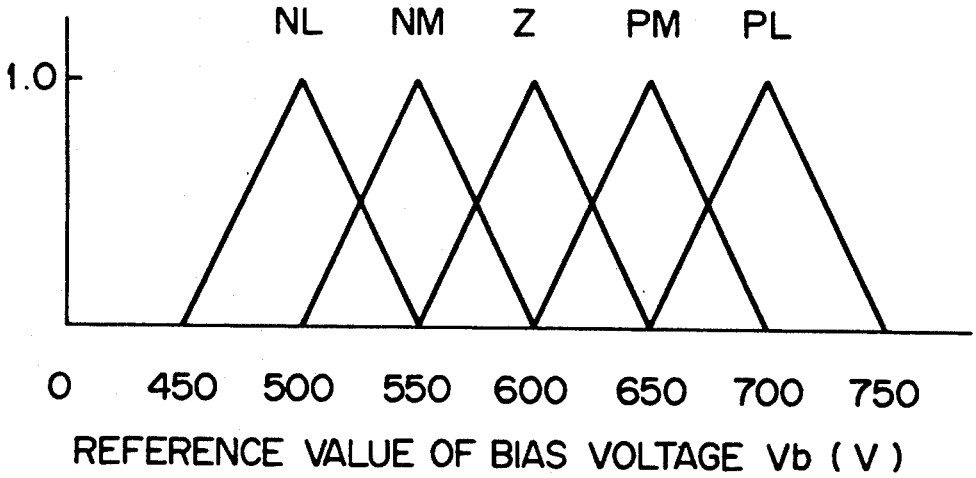
Figure 20:
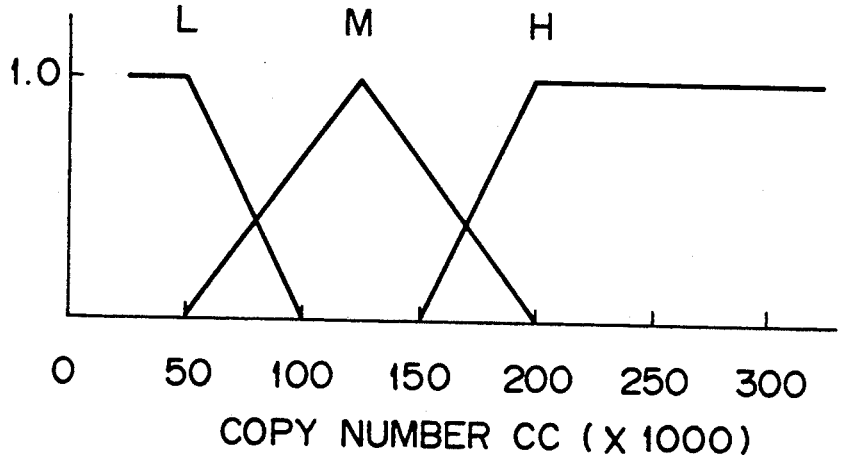
Figure 21:
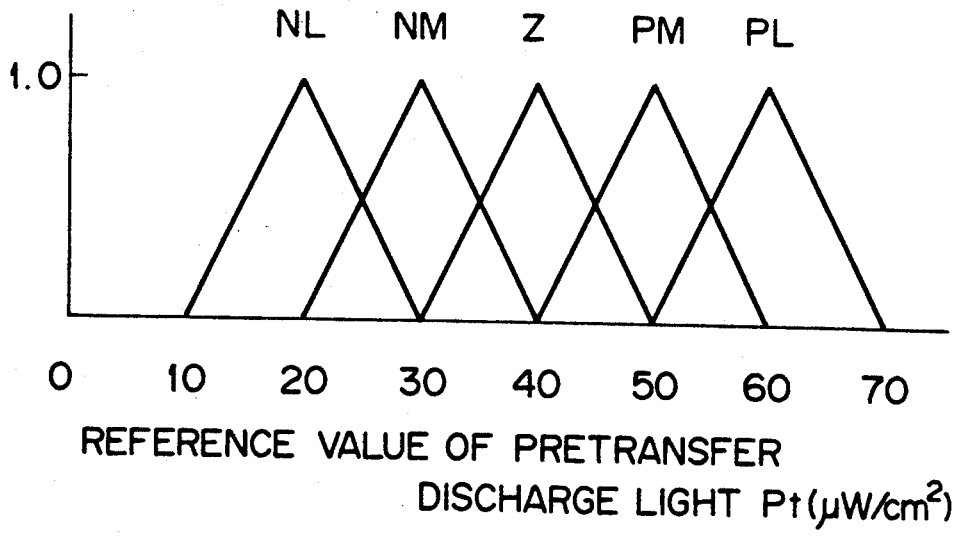
Figure 22:
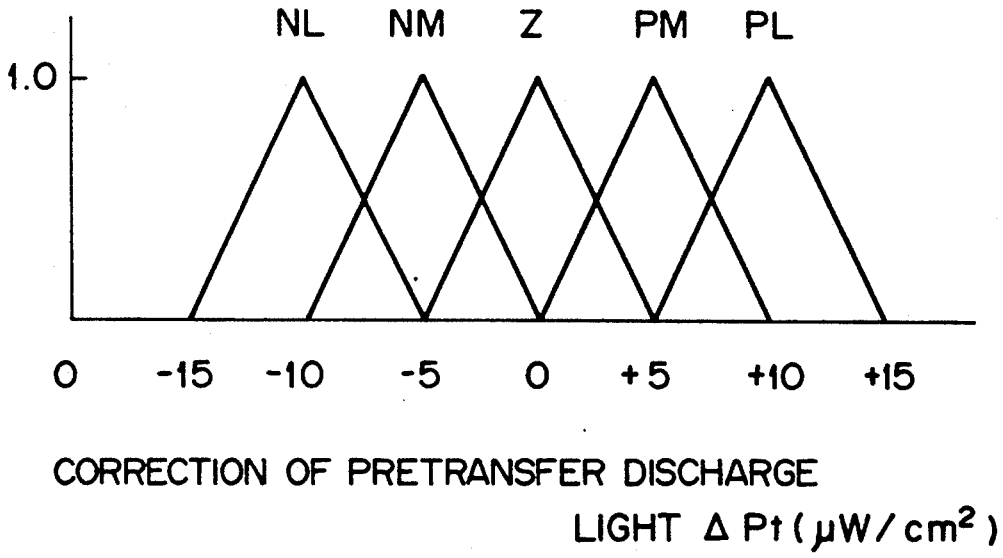

FIG. 16 is a graph showing the membership function of the paper thickness (D). FIG. 17 is a graph showing the membership function of the correction amount (ΔTb) of the transfer voltage to be controlled. FIG. 18 is a graph showing the membership function of the correction value (ΔVb) of the bias voltage for development to be controlled. FIG. 19 is a graph showing the membership function of the reference value (Vb) of the bias voltage to be controlled. FIG. 20 is a graph showing the membership function of the number of copies produced (CC). FIG. 21 is a graph showing the membership function of the reference value (PT) of the quantity of light for pretransfer discharge. FIG. 22 is a graph showing the membership function of the correction value (ΔPt) of the quantity of light to be controlled.

In summary, it will be seen that the present invention provides an image forming method which promotes efficient image transfer to a paper sheet and efficient separation and transport of a paper sheet. Hence, the method of the invention insures stable images with no regard to the kind of paper and environmental conditions while remarkably reducing the frequency of paper jam at image transfer and paper separation stations. The method of the invention minimizes the amount of toner that remains on a photoconductive element after image transfer, thereby enhancing the cleaning ability and reducing wasteful toner consumption. In addition, since the method of the invention classifies variable factors and estimates a condition as a combination of membership functions, it simplifies the control system and enhances accurate control.

Various modifications will become possible for those skilled in the art after receiving the teachings of the present disclosure without departing from the scope thereof.

What is claimed is:

1. In an image forming method forming an image by transferring a toner image formed on a photoconductive element to a recording medium, variable factors associated with image transfer, paper separation and paper transport characteristics are classified into one of short-term, medium-term and long-term factors, and an image transfer state, a paper separation state and a paper transport state are each estimated as a combination of membership functions of said variable factors to thereby determine an image transfer condition, a paper separation condition and a paper transport condition, whereby control is effected on the basis of said determined conditions at predetermined timings which correspond to said short-term, medium-term and long-term factors.

2. A method as claimed in claim 1, wherein the variable factors are classified with respect to time.

3. A method as claimed in claim 1, wherein the variable factors are classified with respect to a characteristic of a photoconductive element, a characteristic of a developer, a characteristic of a recording medium, a characteristic of an ambient condition, and a characteristic variable with time.

4. A method as claimed in claim 1, wherein the variable factors are classified with respect to a characteristic of an image forming apparatus and other characteristics.

5. An image forming method for forming an image by transferring a toner image formed on a photoconductive element to a recording medium, variable factors affecting image transfer, paper separation and paper transport are classified into one of short-term, medium-term and long-term factors, and an image transfer state, a paper separation state and a paper transport state are each estimated as a combination of membership functions of said variable factors to thereby determine an image transfer condition, a paper separation condition, a paper transport condition as well as a toner image forming condition on said photoconductive element, whereby control is executed on the basis of said conditions at predetermined timings which correspond to said short-term, medium-term and long-term factors.

6. A method as claimed in claim 5, wherein the variable factors are classified with respect to time, and an image transfer state, a paper separation state and a paper transport state are each estimated as a combination of membership functions of said variable factors to thereby determine an image transfer condition, a paper separation condition, and a paper transport condition, whereby control is selectively executed on the basis of said conditions determined.

7. A method as claimed in claim 5, wherein an image transfer state, a paper separation state and a paper transport state are each estimated as a combination of membership functions of the variable factors in matching relation to said timings for detecting said variable factors to thereby determine an image transfer condition, a paper separation condition, a paper transport condition, as well as an image forming condition on the photoconductive element, whereby control is selectively executed on the basis of said conditions determined.

* * * * *